US005451374A

United States Patent [19]

Molina

[11] Patent Number: 5,451,374

[45] Date of Patent: Sep. 19, 1995

[54] MEDICINE VESSEL STOPPER

[75] Inventor: Roger V. Molina, Kernersville, N.C.

[73] Assignee: Incutech, Inc., Greensboro, N.C.

[21] Appl. No.: 110,375

[22] Filed: Aug. 23, 1993

[51] Int. Cl.[6] ..... B01L 3/00

[52] U.S. Cl. ..... 422/99; 422/101; 215/248; 215/249; 215/251; 604/403; 604/405; 604/406; 604/415; 220/253; 220/257

[58] Field of Search ..... 422/99, 101, 102; 215/248, 251, 249; 604/126, 415, 82, 84, 11, 403, 405, 406; 220/257, 253

[56] References Cited

U.S. PATENT DOCUMENTS

| | | | |
|---|---|---|---|
| 4,287,065 | 9/1981 | Raines | 210/445 |
| 4,346,703 | 8/1982 | Dennehey et al. | 128/213 A |
| 4,815,619 | 3/1989 | Turner et al. | 215/248 |

OTHER PUBLICATIONS

Capping Devices-Manufacturer Data Sheet from Burron Medical Inc. Sep. 1991.

ChemoBloc Vial Venting System-Manufacturer Data Sheet from U.S. Clinical Products, Inc.

ChemoBloc Vial Venting System-Manufacturer Data Sheet.

Allvent Vial Venting System-Manufacturer Data Sheet from Healthtek-Catalog No. 7DF007-Metal & 7DF008-Plastic.

Chemo-Dispensing Pin-Manufacturer Data Sheet from Burron Medical, Inc.

Transfer and Filter device-Manufacturer Data Sheet from Burron Medical Inc.

CytoSafe Needle-Manufacturer Data Sheet from Baxa Corporation.

Manufacturer Instruction Sheet from Baxa Corporation.

Medical Grade Disc Filters-Manufacturer Data Sheet from Healthtek.

*Primary Examiner*—David A. Redding

*Attorney, Agent, or Firm*—Lyon & Lyon

[57] ABSTRACT

Stoppers for medicine vessels are disclosed. Such stoppers comprise an insert having one end frictionally engageable within an opening in a medicine vessel. Such inserts' other ends have a fitting, e.g. a luer complimentary with a luer on an opening in the medicine vessel. The fitting allows the contents of the medicine vessel to be withdrawn without using a sharp object, such as a needle.

32 Claims, 7 Drawing Sheets

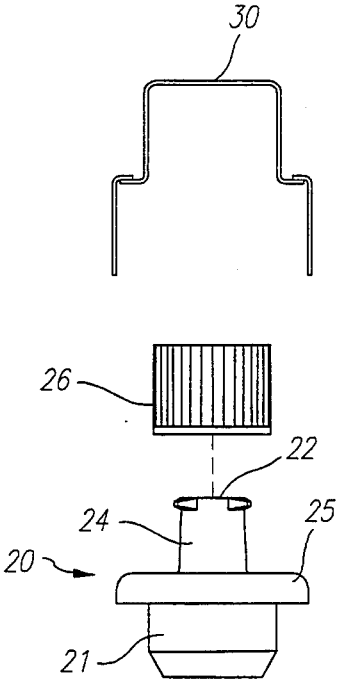
FIG. 2A
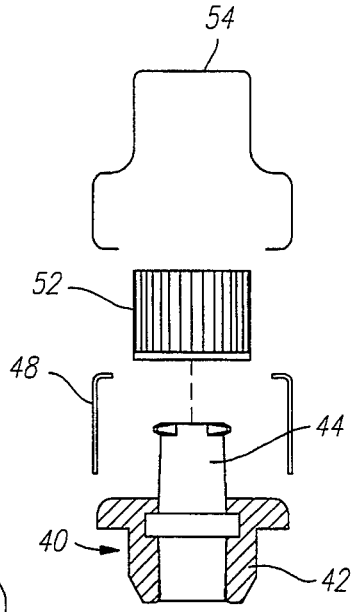
FIG. 2B
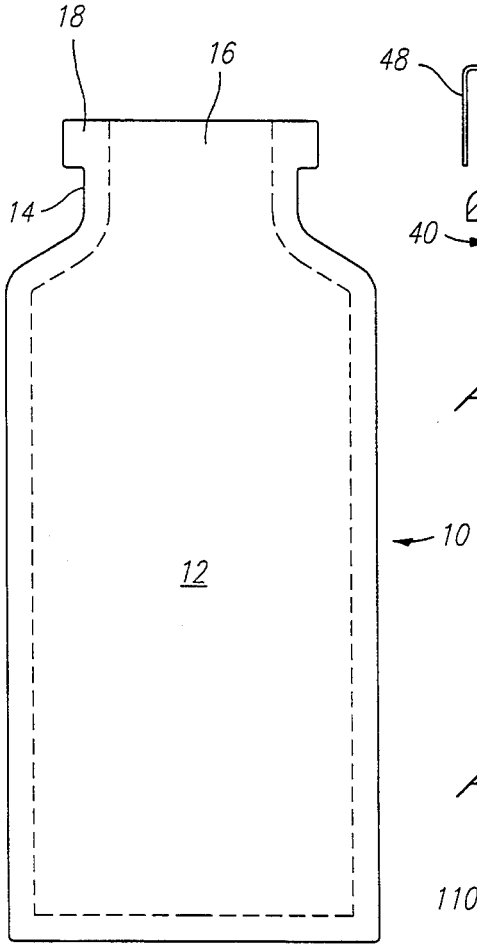
FIG. 1
(PRIOR ART)
FIG. 2C
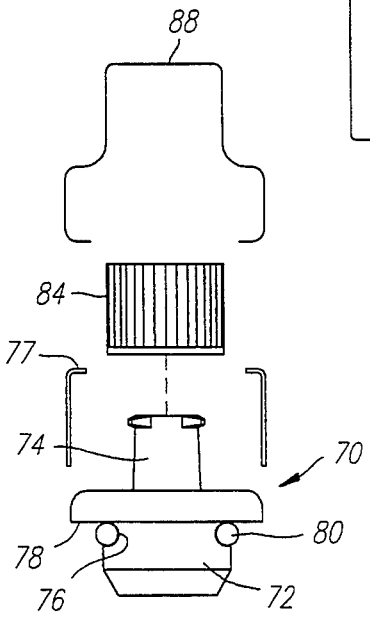
FIG. 2D
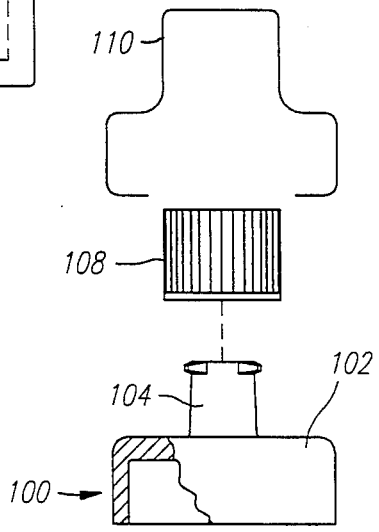

MEDICINE VESSEL STOPPER

BACKGROUND OF THE INVENTION

This invention relates to stoppers for medicine vials and bottles.

Medicine vessels, usually vials or bottles, for storing medicinal liquids and powders, and for containing specimens, usually liquids, for testing or other procedures, can be constructed of many different types of materials, including glass and various plastics. Openings in these vessels to allow access to their contents are usually sealed by stoppers or diaphragms.

One type of stopper that is commonly used is tapered, much like a cork, such that the integrity of the seal between the stopper and the vessel increases as the stopper passes further into an opening in the vessel adapted to receive it. Other stoppers that have been used are custom shaped to conform to the internal contours of the vessel's opening. Still others act as caps, shaped so that they can snap closed over an opening in the bottle or vial. It is also possible to crimp a stopper onto a lip formed in the bottle or vial. Such prior art stoppers are usually constructed of rubber or like elastomeric materials, or relatively rigid materials, e.g. rigid plastics.

One type of stopper in common use permits a sharp object to be used to access the vessel's contents. Such sharp objects include needles, spikes (when relatively large volumes must be extracted from a vessel) and hoses (for pumping). Most commonly, a syringe's needle is forced through a stopper in the vessel to access the vessel's contents. The force required to pierce the stopper often causes users to accidentally strike themselves with the sharp object used, causing abrasions or even deep puncture wounds.

Today, it is not uncommon for hospital patients to have infectious diseases, such as AIDS and hepatitis, that are transferable through exchange of body fluids. When a doctor, nurse or medical technician is accidentally wounded with a sharp object that has been contaminated with infectious disease organisms, there is a high probability that that person will become infected as well. Stoppers that allow access to the contents of medicine vessels while obviating the need to handle sharp objects are thus highly desirable, in that they will reduce or eliminate exposure by medical personnel to body fluid-borne infectious diseases, as well as to abrasions and puncture wounds.

SUMMARY OF THE INVENTION

The present invention provides a novel and unique method and apparatus for sealing medicine vessels while providing access to their contents.

In brief, the present invention provides inserts or stoppers for such vessels which comprise an annular plug having an attachment end and a fastening end. The annular plug, which can be formed of a natural or synthetic elastomeric material, can have an annular lip formed therein or added thereto such that when the plug frictionally engages an opening in a medicine vessel the lip will rest on the periphery of this opening, serving to further seal the opening. The fastening end of such an insert will be placed in an opening in a medicinal vessel to be sealed. The insert's attachment end is adapted by means of a fitting or the like that permits access to the contents of the vessel without the necessity of the vessel's, or a stopper therein, being pierced by a sharp object.

Accordingly, it is an object of the present invention to provide novel stoppers for medicine vessels.

A further object of the present invention is to provide improved stoppers that allow access to medicine vessels without the use of a sharp object.

Other and further objects and advantages of this invention will become apparent hereafter.

BRIEF DESCRIPTION OF THE DRAWINGS

Reference is made to the accompanying drawings, which show illustrative embodiments of the invention. From these drawings the novel features and advantages of the invention will be apparent to those of ordinary skill in the art.

FIG. 1 is a cross-sectional view of a typical medicine vessel.

FIGS. 2A, 2B, 2C and 2D show views of various embodiments of medicine vessel stoppers of the invention.

DESCRIPTION OF THE PREFERRED EMBODIMENTS

Figure 3A:
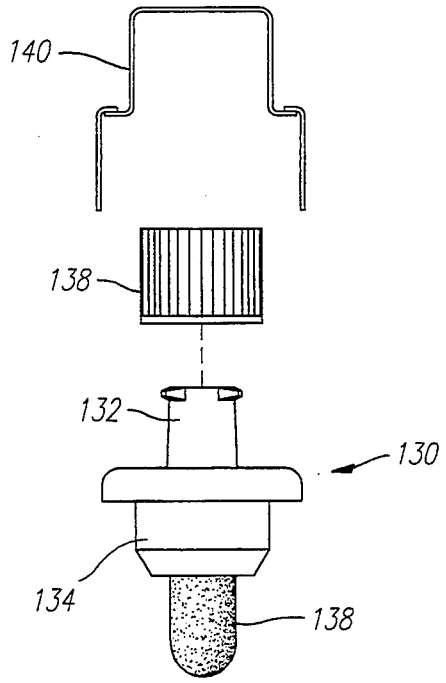
FIGS. 3A, 3B, 3C, 3D, 3E, 3F, and 3G show views of various embodiments of filtered medicine vessel stoppers of the invention.

Referring to the drawings, and in particular, FIG. 1, there is seen a typical prior art medicine vial or specimen vial 10. The vial 10 has a cavity 12 and a neck 14 with an opening 16. Formed integrally at the opening 16 is a lip 18. When in use, the vial 10 will contain either liquid or powdered materials (not shown).

In order to seal the vial 10 so that its contents are accessible and easily removable, in one embodiment of the invention, shown in FIG. 2A, an integral luer fitting 20 is placed in an opening 16 of the vial 10. The integral luer fitting 20 allows access to material within the vial 10 by means of a channel (not shown) that runs through the center of the luer fitting 20. The luer fitting 20 can be constructed of any suitable material, including but not limited to pliant, conformable synthetic plastics, such as low density polyethylene, polypropylene, or the like. The luer fitting 20 is formed so that it stays in the opening 16 by means of frictional force between the neck 14 of the vial 10 and the bottom wall 21 of the luer fitting 20. A suitable band or crimp ring (not shown) that engages both the lip 18 of the vial 10 and the top surface of the lip 25 of the fitting 20 can also be used to fasten the fitting 20 to the vial 10. On the top portion 24 of the integral luer fitting 20 there is a female luer 22. A lip 25 is formed on this female luer 22 so that when the fitting 20 is placed in an opening 16 of the vial 10, it rests on the vial lip 18.

Luers are an attachment means well known to those skilled in the art. They allow fast, simple and secure connections between devices. In general, a connection is made by placing a device having a male luer in contact with the female luer of another device and twisting the luers together until they lock. ANSI standard luers can be used in the various embodiments of the present invention to allow attachment of these stoppers to compatible syringes and the like.

Figure 5:
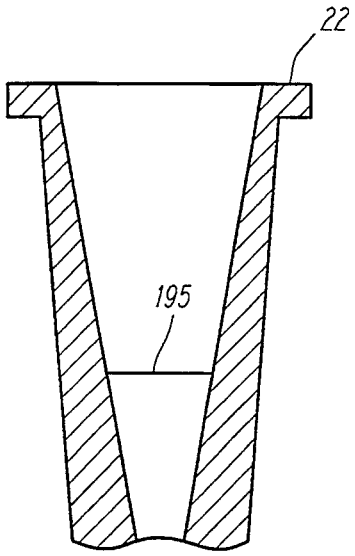
FIG. 5 shows a membrane placed within a channel of a luer fitting.

Prior to use, a medicine vial, e.g. the vial 10 of FIG. 1, must be sealed in order to avoid spillage and loss of sterility of the material it contains. Thus, a protective cap 26 that fits the luer 22 will generally be attached to a fitting 20; see, e.g., FIG. 2A. Such a protective cap 26 will usually be non-vented and sterile, thus providing a complete barrier between material in the vial 10 and the external environment. Alternatively or in addition, a membrane 195, as shown in FIG. 5, can be placed within the channel in the luer fitting 22. Such a membrane 195 would be ruptured upon insertion of a luer fitting complementary to that of the luer fitting 22, thereby allowing access to the contents of the vial 10.

A tamper-proof cover 30 can be disposed over the protective cap 26 and the fitting 20 illustrated in FIG. 2A. The tamper-proof cover 30 can be constructed of plastic film, metal foil or the like. Depending on the material used, the tamper-proof cover 30 can be shrink wrapped or crimped to cover the protective cap 26, the luer fitting 20 and the lip 18, thereby forming a one-time removable barrier over these elements.

In another embodiment, instead of an integral luer fitting 20, a two-piece luer fitting 40, comprising a ring 42 and luer insert 44, is used. The ring 42 fits into an opening 16 in the vial 10 (not shown) in frictional engagement, and can be constructed of various materials, including but not limited to rubber. A luer insert 44 slides into the ring 42 such that a seal is formed between these two components. A band 48 is crimped over the ring 42 and the lip 18 of the vial 10 to fasten the luer fitting 40 to the vial 10 and enhance sealing between them. The band 48 can be constructed of various materials, including but not limited to pliant plastics and various metal foils. As in the embodiment discussed above, a complimentary protective cap 52 can be fastened to the luer insert 44 in order to maintain sterility and prevent spillage of the contents of a medicine vessel sealed with this embodiment. Alternatively or in addition, a membrane 195, as shown in FIG. 5, can be formed within a channel (not shown) in the luer fitting 40. A tamper-proof cover 54, shown in FIG. 2B, can also be formed over the protective cap 52, the fitting 40 and the lip 18. This tamper-proof cover 54 is shown in FIG. 2B in the shape it will attain after either crimping or shrink wrapping.

FIG. 2C shows an another embodiment of a stopper according to this invention that will provide non-puncturing access to the contents of a medicine vessel, e.g. the vial 10. Here, a luer fitting 70 has a fastening portion 72 and a luer end 74. The fastening portion 72 and the luer end 74 can be integral or separate parts that are fastened together. A band 77 is crimped over the luer fitting 70 and the lip 18 of the vial 10 (not shown) to fasten the fitting 70 to the vial 10. The band 77 will also enhance the seal between the fitting 70 and the vial 10. The band 77 will further enhance the seal between the fastening portion 72 and the luer end 74 if they are two separate parts. The band 77 can be constructed of various materials, including but not limited to pliant plastics and various metal foils. A groove 76 is formed at the intersection of the fastening portion 72 and the lip 78. An O-ring 80 is placed in the groove 76. When the fitting 70 is placed in an opening 16 of the vial 10, friction between the fastening portion 72 and the vial 10 maintains the fitting 70 in place. An O-ring 80 will increase the integrity of this seal.

As in the other previously-discussed embodiments, a channel (not shown) runs from the luer end 74 through the fitting 70 and out the fastening portion 72. This channel allows access to the contents of the vial 10. In order to seal this channel and thereby protect the contents of the vial 10 from spillage and contamination, a protective cap 84 can be fastened to the luer end 74 of the luer fitting 70. Alternatively or in addition, a membrane 195, as shown in FIG. 5, can be formed within the channel in the luer fitting 70. A tamper-proof seal 88 can be placed over the protective cap 84, the fitting 70 and the lip 18 as described above.

Another embodiment of the invention, shown in FIG. 2D, gives an alternative means of providing access to the contents of a vial 10. In this embodiment, a luer fitting 100 has an over-cap portion 102 and a luer end 104. The fitting 100 can be constructed of metal, plastic or other suitable material. In order to place the fitting 100 on the vial 10 (not shown) such that a seal is formed, an over-cap portion 102 can be crimped over the lip 18. The luer fitting 100 may also be designed to snap onto the lip 18. This provides a seal of high integrity that is simple to manufacture.

In much the same fashion as in the embodiments discussed above, FIG. 2D shows a protective cap 108 fastened to luer end 104 of a luer fitting 100. Alternatively or in addition, a membrane 195, as shown in FIG. 5, can be formed within the channel in the luer fitting 100. A tamper-proof cover 110 can be placed over the protective cap 108, the luer fitting 100 and the lip 18, as discussed above.

The above-described embodiments of the invention eliminate the need to force a sharp object through a stopper in order to gain access to vessel's contents. Instead, the user simply attaches a device having a port complimentary to the luer connection on any of the luer fittings 20, 40, 70 and 100. This greatly reduces one's chance of puncturing his or her skin which, as described above, can also reduce the chance, in a given situation, of exposure to body fluid-borne infectious diseases.

In a given case, the consistency and sterility of a medication stored in a medicine vessel may not be known prior to the medication's use. Medications are often filtered prior to administration in order to remove debris, solids, undissolved materials and other contaminants from them. In various embodiments of the present invention, a filter can be fastened directly to a luer fitting on a stopper on a medicine vial. As will be seen, this will eliminate the need to use sharp objects to withdraw the contents of such containers, thereby, at a minimum, reducing the chance of drug contamination.

FIG. 3 shows still further embodiments of the invention. Oftentimes, the material (not shown) within a medicine vial 10 (also not shown) must be purified prior to use. As discussed, one common method of purification is filtration. In FIG. 3A, an integral luer fitting 130 is shown. This fitting 130 has a luer end 132 and a fastening end 134. The fitting 130 can be constructed of natural or synthetic elastomeric materials, thermoplastic materials or the like and can be assembled in a similar manner to the embodiment shown in FIG. 2A.

The fastening end 134 of the fitting 130 is inserted into an opening 16 in a medicine vial 10, where it forms a seal between the fitting 130 and the vial 10. In this embodiment, friction between the fastening end 134 and the vial 10 maintains the fitting 130 in position. A suitable band or crimp ring (not shown) can also be formed over the fitting 130 to the vial 10. As in the above embodiments, a channel (not shown) that runs from the luer end 132, through the fitting 130, and out the fastening end 134 of the stopper allows access to the contents of the vial 10.

A filtration element 138 is placed on the fastening end 134 of the fitting 130. It is positioned so that it is collinear with and completely covering the channel in the fitting 130. The filtration element 138 can be constructed of solid sintered metal, a polypropylene, nylon, polysulfone or cellulose acetate polymer, or any other material capable of being used to make a hydrophilic filter. Where the fitting 130 and filter 138 are to be constructed of the same material, they may be formed integrally with each other. In the case of dissimilar materials, the fitting 130 and the filter 138 may be joined in a secondary process. A protective cap 138 is fastened to the fastening end 134 that completely seals the vial 10 (not shown). Alternatively or in addition, a membrane 195, as shown in FIG. 5, can be formed within the channel in the luer fitting 130. A tamper-proof seal 140 is formed over the cap 138, the fitting 130 and the lip 18. The manner in which such tamper-proof seal is installed is discussed above.

Figure 3B:
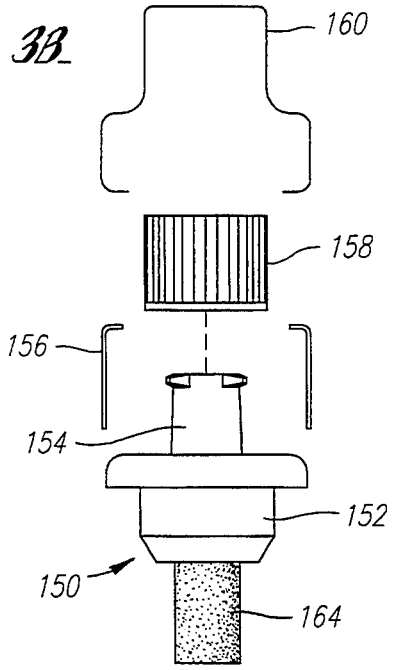

Among the various additional embodiments of the present invention that are contemplated are these:

In FIG. 3B, a two piece luer fitting 150 comprised of a ring 152 and a luer end 154 is shown. The luer fitting 150 of this embodiment is similar to that shown in FIG. 2B. The ring 152 is typically constructed of a pliable, deformable material such as rubber. The luer end 154 can be constructed of an elastomeric material, a thermoplastic, a metal or the like. A band (crimp collar) 156 is placed over the fitting 150 and the lip 18 of a vial 10 (not shown) in order to secure the fitting 150 to the vial 10 and enhance the seal between them. A band 156 will also aid in sealing the luer end 154 and the ring 152. Disposed through the luer end 154 and the ring 152 is a channel (not shown) that allows access to the contents of the vial 10.

A protective cap 158 can be placed over the luer end 154. The cap 158 seals the vial 10, preventing the contents of the vial 10 from escaping. Alternatively or in addition, a membrane 195, as shown in FIG. 5, can be formed within the channel in the luer fitting 150. A tamper-proof seal 160, described above, can also be formed over the luer fitting 150 and cap 158.

In this embodiment, a filter element 164 is disposed on the ring 152 that completely covers and is collinear with the channel (not shown) passing through the luer fitting 150, just as described immediately above.

Figure 3C:
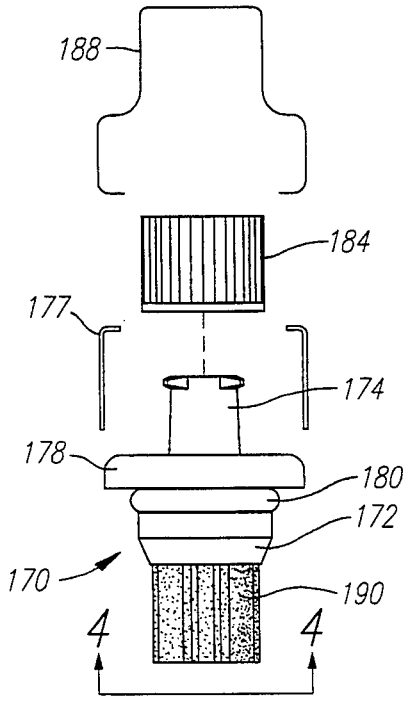

In yet another embodiment, shown in FIG. 3C, a luer fitting 170 is constructed in a similar fashion to that of the embodiment shown in FIG. 2C. The fitting 170 has a fastening portion 172 and a luer end 174. The fastening portion 172 and the luer end 174 can be integral or separate parts that are fastened together. A band 177 is crimped over a fitting 170 and the lip 18 of the vial 10 (not shown) to fasten the fitting 170 to the vial 10. A band 177 will also enhance the seal between the fitting 170 and the vial 10. The band 177 will further enhance the seal between the fastening portion 172 and the luer end 174 if they are separate parts. The band 177 can be constructed of various materials, as described above. A groove (not shown) is formed at the intersection of the fastening portion 172 and the lip 178. An O-ring 180 is placed in this groove. When a luer fitting 170 is placed in an opening 16 of the vial 10, friction between the fastening portion 172 and the vial 10 maintains the luer fitting 170 in place. An O-ring 180 increases the integrity of the seal.

As in the previously discussed embodiments, a channel (not shown) runs from the luer end 174, through the fitting 170, and out the fastening portion 172 to provide access to the contents of the vial 10. To seal this channel, thereby protecting the contents of the vial 10 from spillage and contamination, a protective cap 184 can be fastened to the luer end 174 of the luer fitting 170. Alternatively or in addition, a membrane 195, as shown in FIG. 5, can be formed within the channel in the luer fitting 170. A tamper-proof seal 188 can also be placed over the protective cap 184, the luer fitting 170 and the lip 18 as described above.

Figure 4:
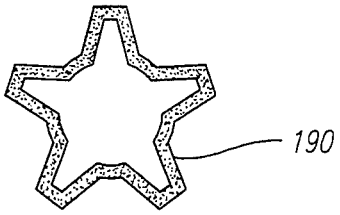
FIG. 4 shows a bottom cross-sectional view of a filter affixed to the medicine vessel stopper of FIGS. 3C and 3G.

A filter 190 is disposed on the fastening portion 172 such that it completely covers and is collinear to a channel (not shown) running through the luer fitting 170. In the embodiment shown, a filter 190 is formed in a star shape to increase its surface area. This is illustrated in FIG. 4. Of course, the invention is not limited to the use of a star-shaped filter, as any filter shape that increases surface area while providing the required strength can be used. Having increased surface area also increases filter longevity.

Figure 3D:
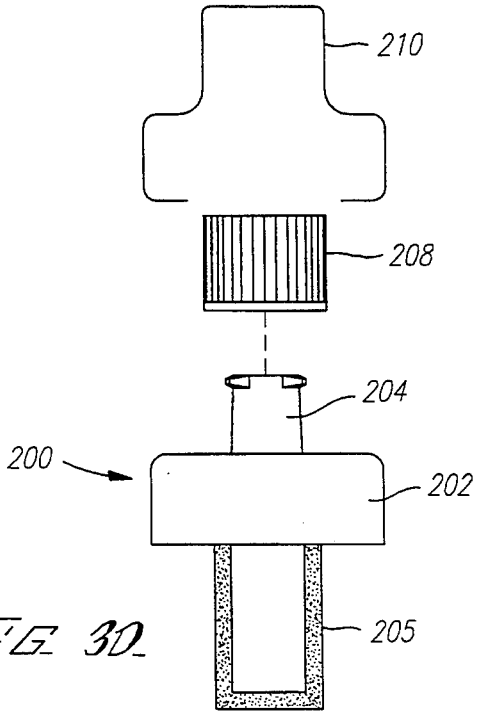

FIG. 3D shows yet another embodiment of the invention, which gives an alternative means of providing access to the contents of the vial 10 (not shown). In this embodiment, the luer fitting 200 has an over-cap portion 202 and a luer end 204. The fitting 200 can be constructed of metal, plastic or other suitable material. In order to place the luer fitting 200 on the vial 10 to form a seal, an over-cap portion 202 can be crimped onto the lip 18, thereby providing a seal of high integrity that is simple to manufacture. Alternatively, the over-cap portion 202 can be designed so that it snaps onto the lip 18 of the vial 10.

In much the same fashion as in the other embodiments of FIG. 3, a protective cap 208 can be fastened to the luer end 204 of the fitting 200. Alternatively or in addition, a membrane 195, as shown in FIG. 5, can be formed within the channel in the luer fitting 200. A tamper-proof cover 210 can be placed over the protective cap 208, the fitting 200 and the lip 18, as discussed above.

A filter 205 is disposed beneath the over-cap portion 202 such that it completely covers and is collinear with the channel running through the luer fitting 200. As shown here, the filter 205 is a basket-type filter. Of course, any filter having the requisite filtration characteristics and strength can be used, and the embodiment of FIG. 3D is not be to construed as limiting.

Figure 3E:
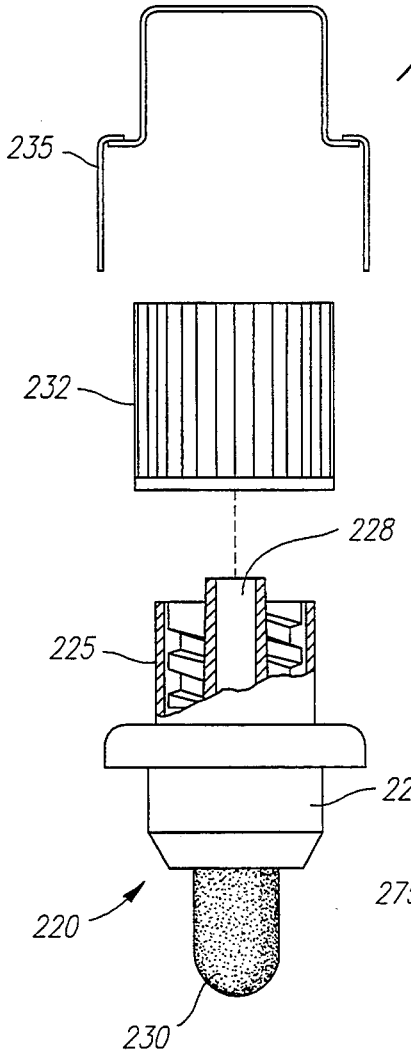

FIG. 3E shows an alternative means of providing access to the contents of the vial 10 (not shown). This embodiment differs from the foregoing embodiments in that the fitting 220 has a male luer end 225. The fitting 220 also has a fastening end 222 that fits into an opening 16 in the vial 10. A band or crimp ring (also not shown) that engages both the lip 18 of the vial 10 and the fitting 220 can also be used to fasten the fitting 220 to the vial 10. Running from the luer end 225 through the luer fitting 220 is a channel 228. A filter 230 is disposed on the luer end 222 such that it completely covers the channel. The filter 230 can be any of the types discussed above.

A protective cap 232 is fastened to the luer end 225 of the luer fitting 220. Alternatively or in addition, a membrane 195, as shown in FIG. 5, can be formed within the channel in the luer fitting 220. A tamper-proof cover 235 can be placed over the protective cap 232, the fitting 220 and the lip 18 using any of the methods discussed above.

Figure 3F:
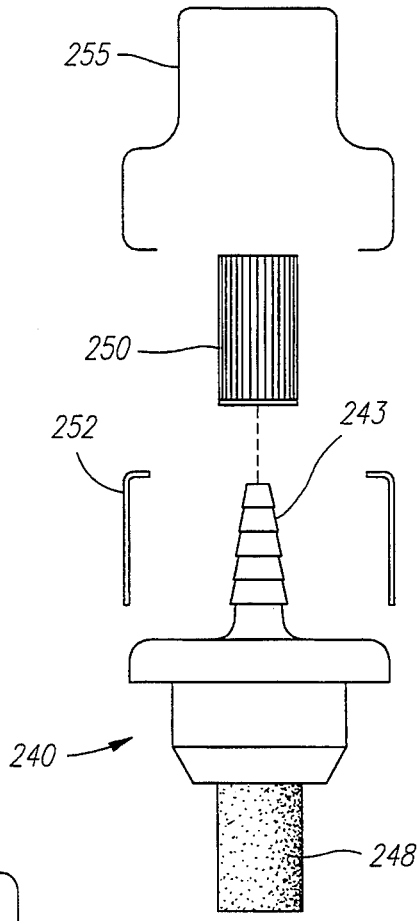
Figure 3G:
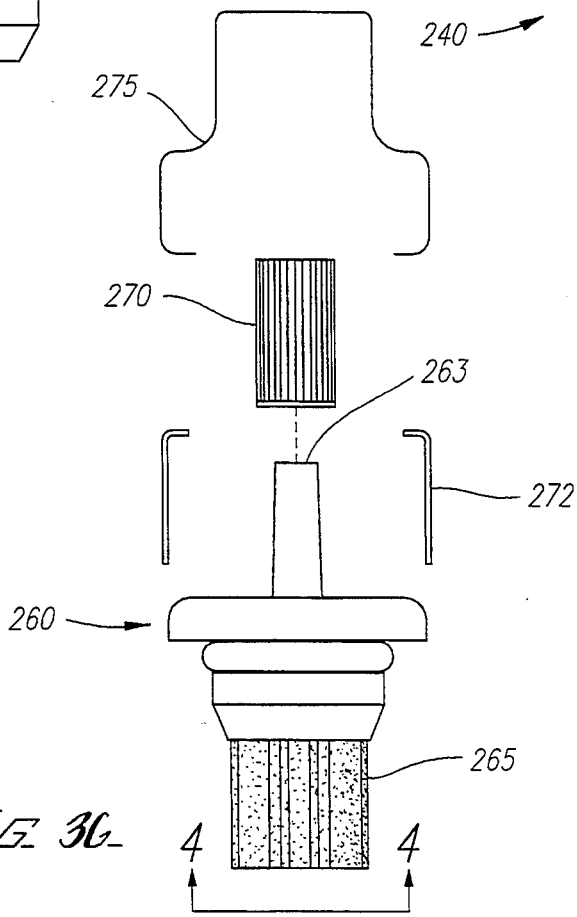

FIG. 3F shows an alternative means of providing access to the contents of a vial 10 (not shown). Here, a fitting 240 having a graduated tube nozzle 243 (for volume dispensing purposes) is provided. This allows a hose or tube (not shown) to be used to gain access to the contents of the vial 10. This type of connector can be advantageous when using a pump to draw the contents out of the vial 10, since such pumps generally use tubing and not luer-type attachment means.

In the embodiment shown, a filter 248 is attached to the fitting 240 such that it completely covers and is collinear with a channel (not shown) running through the fitting 240. A band 252 can be crimped or formed over the fitting 240. A band 252 can also be crimped or formed over the vial 10. If the fitting 240 comprises more than one component, a band 252 will provide additional protection. A protective cap 250 can be fastened to the nozzle 243 of the fitting 240. Alternatively or in addition, a membrane 195, as shown in FIG. 5, can be formed within the channel in the luer fitting 260. A tamper-proof cover 275 can be placed over the protective cap 270, the fitting 260 and the lip 18 using any of the methods discussed above.

Traditional methods used to filter the contents of medicine vessels customarily involve several contacts with sharp objects. The first step in such methods usually involves piercing the medicine vessel's seal with a sharp object. For discussion purposes, a syringe and its needle will be used, and those skilled in the art will recognize the equal advantages of the invention that can be obtained using other drug delivery systems.

After piercing the seal, the user draws the medicine into the syringe. To then filter the medicine, the user removes the needle from the syringe, places a filter disk on the syringe's end and replaces the needle. When the medicine is administered, or transferred to a receiving vessel (not shown), it will pass through the filter disk, thereby filtering the medicine. This traditional filtering method, however, involves the user's piercing the vessel's seal with a needle, handling an exposed needle twice and making contact with the end of the syringe a total of three times.

In the embodiments of the present invention shown in FIGS. 3A, 3B, 3C, 3D, 3E, 3F and 3G, however, the risk of accidental exposure to infectious disease organisms is eliminated and the possibility of contamination of the medicine being administered is reduced. The user simply fastens the luer end of a syringe or other medicine delivery system (not shown) to the complimentary end 132, 154, 174, 204, 225, 243 or 263 of the fitting 130, 150, 170, 200, 220, 240 or 260, installed in a vial 10 (not shown). The user then draws the medicine into the syringe or the like. To pass from the vial 10 to the syringe, the drug must first pass through the filter 138, 164, 190, 205, 230, 248 or 265. After drawing the proper amount of medicine into the syringe, the syringe is removed, and an unused, covered needle is affixed to the syringe. At this point, the filtered, uncontaminated medicine is ready for administration.

Figure 7:
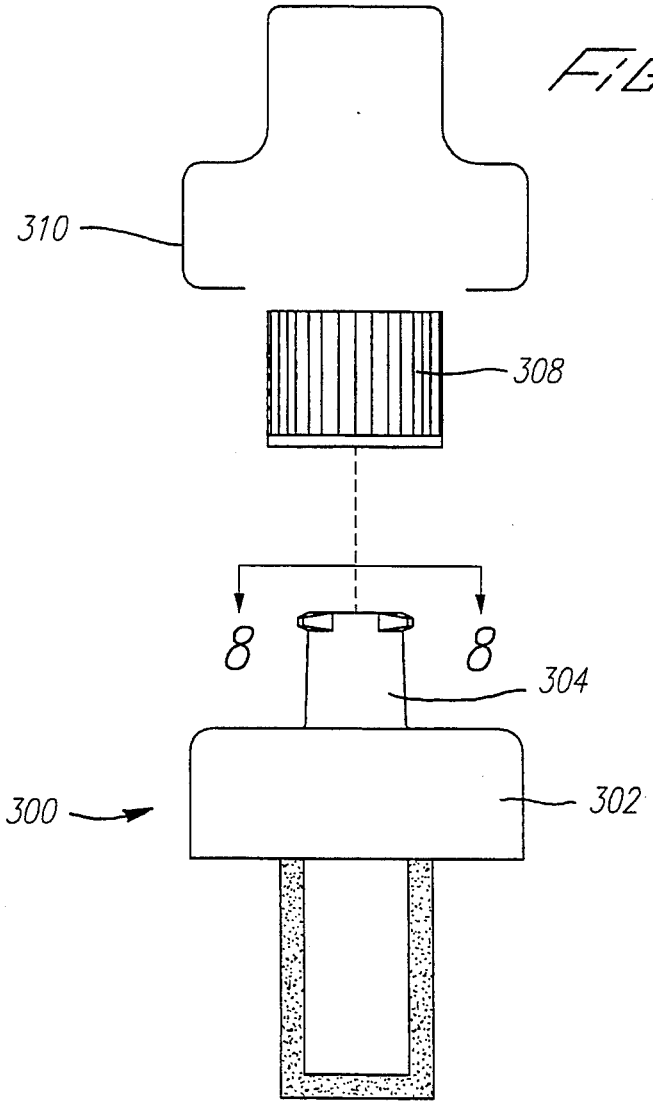
FIG. 7 shows an embodiment of a vented filtered medicine vessel stopper of the invention.
Figure 8:
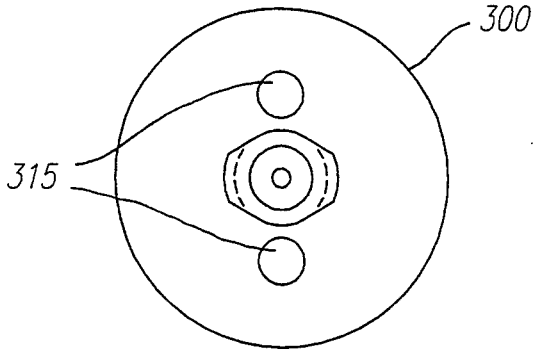
FIG. 8 shows a top view of the vented medicine vessel stopper of FIG. 6.

Referring to FIGS. 7 and 8, an additional embodiment of the invention will be discussed. Dehydrated drugs are often packaged in single-dose vacuum sealed vials. These dehydrated drugs are often toxic or poisonous when they are inhaled or come in contact with the skin. And, prior to administration, such drugs must be reconstituted. Traditionally, these drugs are reconstituted by using a syringe filled with the proper diluent, piercing the seal of a vial containing the dehydrated drug with the syringe's needle and injecting the diluent into a vial 10 (not shown). Finally, the contents of the vial 10 are shaken thoroughly to mix and reconstitute the drug.

Figure 6:
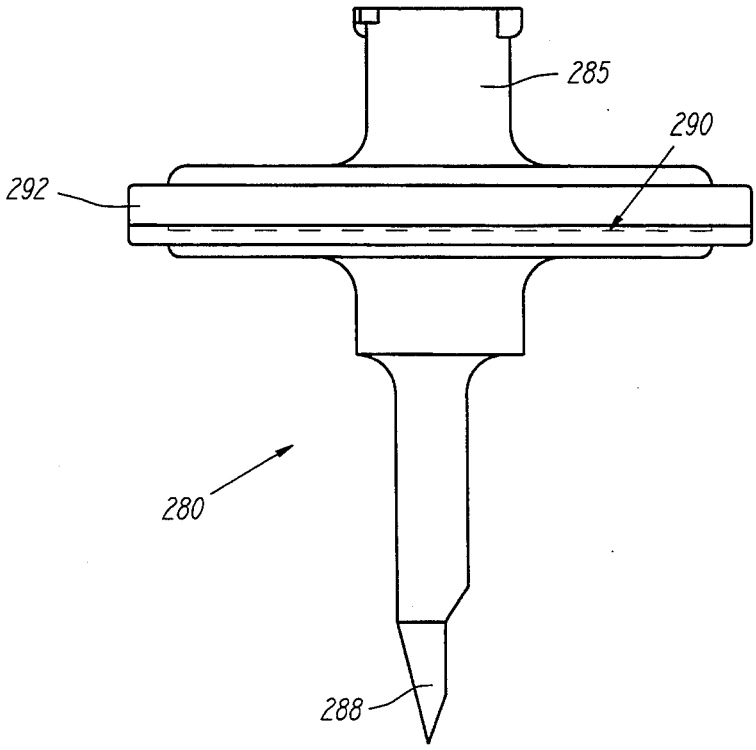
FIG. 6. (PRIOR ART)
FIG. 6 shows a vial vent of the prior art.

At this point, the interiors of the syringe and the vial 10 have the same atmospheric pressure. To reduce the differential between the pressure in the vial/syringe and that of the surrounding atmosphere, a vial vent 280, shown in FIG. 6, is normally used. Traditional vial vents 280 have a female luer end 285 that fits into a syringe (not shown) carrying the diluent. The vial vent 280 has a channel (not shown) that runs from the luer end 285 to a spike 288. A hydrophobic membrane 290 is disposed in a disk 292 that allows for non-pressurized transfer of liquid to and from the vial 10 without allowing either any drug to escape or any contaminating air to enter the system. Thus, the vial vent 280 of the prior art permits dehydrated drugs to be reconstituted without developing a pressure differential between the interiors of the vial/syringe and the surrounding atmosphere. Such systems, however, require the use of a sharp object, which as discussed can expose the user to a toxic drug or to infectious disease organisms, or both.

An embodiment of the invention that provides a vented seal for the vial 10 is shown in FIG. 7. In this embodiment, the luer fitting 300 has an over-cap portion 302 and a luer end 304. The fitting 300 can be fastened to the vial 10 (not shown) in the same fashion as discussed above for FIGS. 2D and 3D. Additional luer fittings resembling those described above can be used. Such alternative luer fittings can be fastened to the vial 10 by a band or crimp ring (also not shown) as described above. Also as described above, a protective cap 308 can be fastened to the luer end 304 of the fitting 300 and a tamper-proof cover 310 can be placed over the protective cap 308, the fitting 300 and the lip 18, as discussed above.

FIG. 8 is a top view of the fitting 300 of FIG. 7, showing the vents 315 formed in the over-cap portion 302 of the fitting 300. The vents are constructed of any suitable membrane comprising hydrophobic material.

Figure 9:
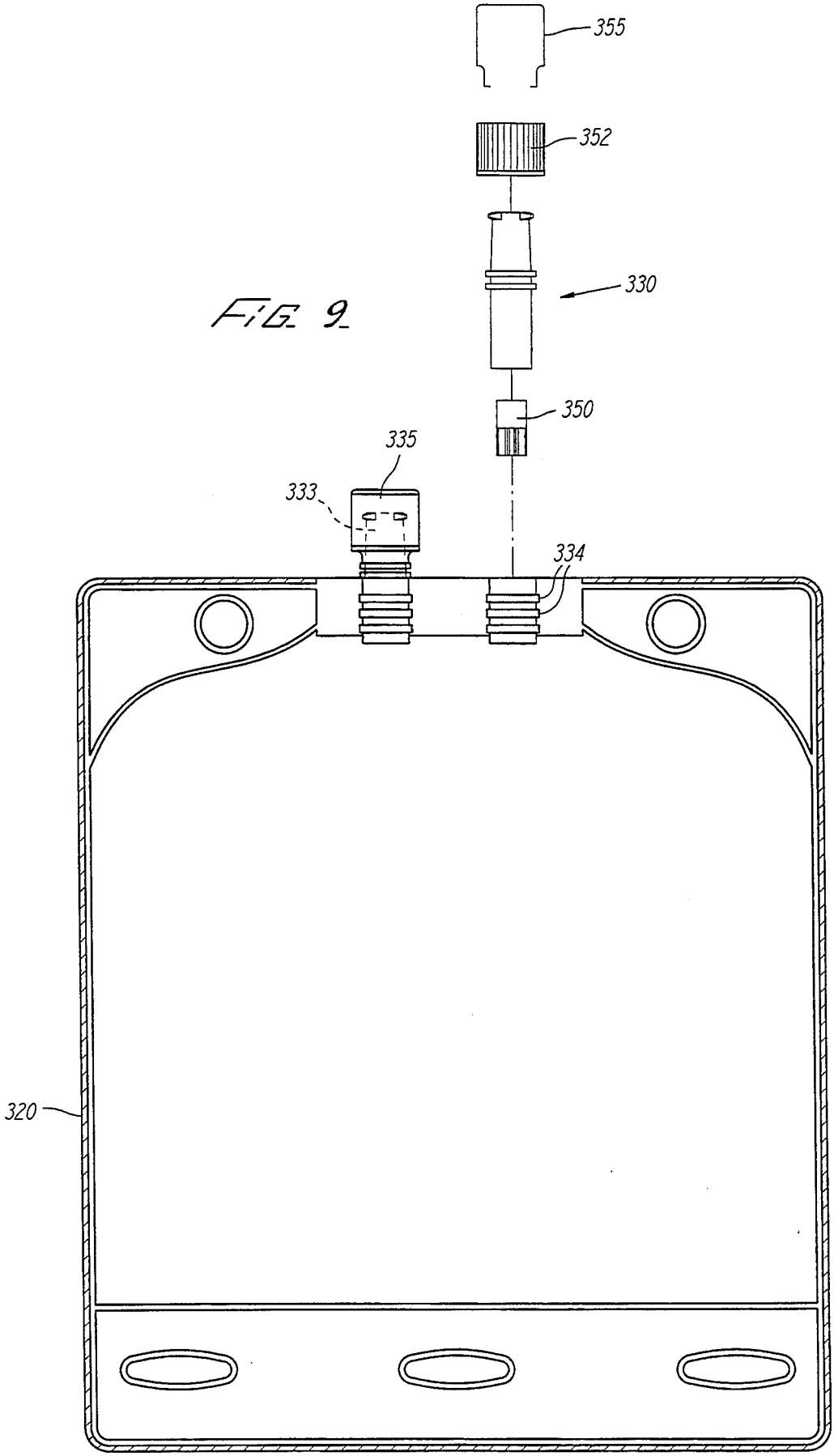
FIG. 9 shows a medicine bag containing one embodiment of a stopper of the invention.

FIG. 9 illustrates the use of the invention when medication is stored in a bag 320. Such bags 320 of the type shown are generally constructed of soft, pliable plastic that allows its shape to be easily manipulated. Traditionally, access to such bags has been obtained by piercing a seal with a sharp object, as discussed above. Because force is necessary to pierce the seal, the sharp object, e.g., a needle, can not only pierce the seal but also accidently pass through the bag, exposing the needle. This exposed needle can then puncture the user, exposing him or her to infectious disease organisms and toxic drugs. And even if the user is not harmed, the bag and its contents have been rendered useless.

The embodiment of the invention shown in FIG. 9 provides access to medicine bags without the need to use sharp objects, thereby eliminating the disadvantages discussed above. In place of a puncturable seal, a luer fitting 330 is used to provide access to the bag's 320 contents. Instead of forcing a sharp object through a seal, the user simply attaches a syringe, tube or the like having a fitting complimentary to that on the fitting 330. A membrane (not shown), similar to that described above, may be placed in the fluid path. In the embodiment shown in FIG. 9, there is also a second port in which another luer fitting 333 is disposed. This fitting 333 can be formed integrally to the bag 320, which eliminates the need for special assembly. A protective cap 335 can be fastened to the integral luer fitting 333.

Figure 10:
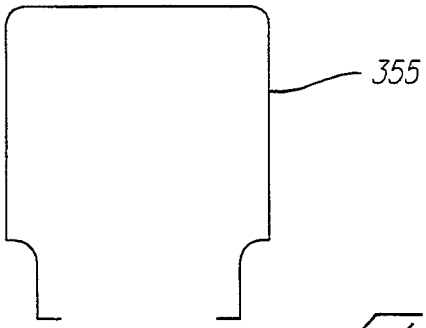
FIG. 10 shows an enlarged view of the medicine vessel stopper of FIG. 9.
Figure 11:
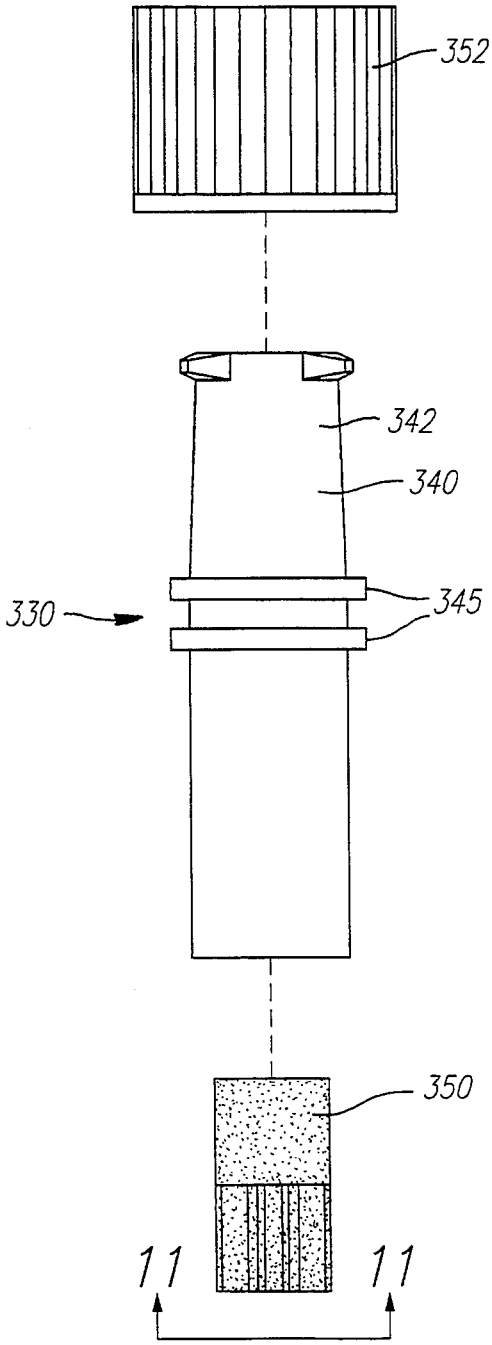
FIG. 11 shows a bottom cross-sectional view of a filter affixed to the medicine vessel stopper of FIG. 10.
Figure 11:
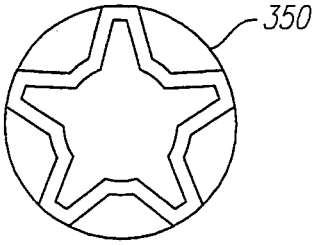

FIG. 10 is an expanded view of the components of the luer fitting 330 which, as shown, comprise an insert 340 having a luer end 342. Ridges 345 that correspond to complimentary grooves 334 that may be present in the bag 320 may be formed on the fitting 330 as a primary or secondary process. When the ridges 345 are present, the fitting 330 is installed in the bag 320 such that the ridges 345 snap into the grooves 334. The ridges 345 and the grooves 334 are not necessary for the device's proper functioning. As shown here, a filter 350 is installed on the fitting 330. The filter 350, as illustrated in the cross-section shown in FIG. 11, can be a star shape, which increases its surface area. Of course, any shape that increases filter surface area can be used. As in the above-described embodiments, a protective cap 352 can be fastened to the luer end 342 of the fitting 330, and a tamper-proof cover 355 can be placed over the protective cap 352 and the fitting 330.

As those skilled in the art will recognize, the various components of the various embodiments of the invention illustrated above can be interchanged, and such further modified embodiments will also be within the scope of the invention. For instance, the luer fitting 130 of the embodiment of FIG. 3A can have the star-shaped filter 190 of the embodiment of FIG. 3C disposed thereon.

Thus, improved means of sealing medicine vessels and providing access to the contents thereof have been provided. While various embodiments and applications of this invention have been shown and described, it will be apparent to those skilled in the art that many more modifications are possible without departing from the inventive concept disclosed herein. The invention, therefore, is not to be considered as being limited except as defined in the appended claims.

I claim:

1. A stopper for a medicine vessel comprising an insert having an attachment end and a fastening end, said fastening end adapted to be frictionally engaged in an opening in said medicine vessel to seal said medicine vessel and said attachment end adapted to permit access by a non-puncture forming medical device to the contents of said medicine vessel, said insert further comprising an annular plug having a luer insert disposed therethrough.

2. The stopper of claim 1 wherein said annular plug further comprises an annular lip formed therein thereby permitting said annular plug to frictionally engage said opening in said medicine vessel while said lip rests on the periphery of said opening in said medicine vessel.

3. The stopper of claim 1 wherein said attachment end comprises a female luer fitting.

4. The stopper of claim 1 wherein said attachment end comprises a male luer fitting.

5. The stopper of claim 1 wherein said attachment end comprises a tube nozzle.

6. The stopper of claim 1 wherein said attachment end comprises a graduated tube nozzle.

7. The stopper of claim 1 wherein said annular plug is constructed of rubber and said luer insert is constructed of a flexible, synthetic elastomeric material.

8. The stopper of claim 1 wherein said annular plug is constructed of rubber and said luer insert is constructed of a rigid material.

9. A stopper for a medicine vessel comprising an insert having an attachment end and a fastening end, said fastening end adapted to be frictionally engaged in an opening in said medicine vessel to seal said medicine vessel and said attachment end adapted to permit access by a non-puncture forming medical device to the contents of said medicine vessel, said fastening end further comprises an annular plug with a lip formed thereon, said fastening end having a groove formed beneath said lip and on said annular plug, said groove having an O-ring disposed therein so that said annular plug and said O-ring frictionally engage said medicine vessel while said lip rests on the periphery of said opening in said medicine vessel.

10. The stopper of claim 1 further comprising a band, said band crimped over said attachment end and the periphery of said opening in said medicine bottle, thereby securing said insert to said medicine bottle.

11. The stopper of claim 1 wherein said fastening end further comprises an over-cap portion shaped such that said over-cap portion fits over the periphery of said opening in said medicine bottle.

12. The stopper of claim 11 wherein said over-cap portion is crimped onto the periphery of said opening in said medicine bottle.

13. A stopper for a medicine vessel comprising:

an insert having an attachment end and a fastening end, said fastening end adapted to be frictionally engaged in an opening in said medicine vessel to seal said medicine vessel and said attachment end adapted to permit access by a non-puncture forming medical device to the contents of said medicine vessel;

a filter, said filter disposed on said fastening end of said insert, said insert having a channel therethrough in communication with said filter to permit material to be drawn, from a medicine bottle through said filter to pass through said channel.

14. The stopper of claim 13 wherein said filter is constructed of solid sintered metal.

15. The stopper of claim 13 wherein said filter is constructed of a polypropylene polymer.

16. The stopper of claim 13 wherein said filter is constructed of a polysulfone polymer.

17. The stopper of claim 13 wherein said filter is constructed of a nylon polymer.

18. The stopper of claim 13 wherein said filter is constructed of a cellulose acetate polymer.

19. The stopper of claim 13 wherein said filter is constructed of a hydrophilic material.

20. The stopper of any one of claims 14–19, inclusive, wherein said filter has a star-shaped cross-section.

21. A filtering stopper for a medicine vessel comprising:

an insert having an attachment end and a fastening end, said insert having a channel therethrough through which said attachment end communicates with said fastening end, said fastening end being frictionally engaged in an opening in said medicine vessel; and a filter disposed on said fastening end, said filter being collinear with and in communication with said channel to permit fluid drawn from said medicine vessel to pass through said filter prior to entering said channel.

22. The stopper of claim 21 wherein said filter is constructed of solid sintered metal.

23. The stopper of claim 21 wherein said filter is constructed of a polypropylene polymer.

24. The stopper of claim 21 wherein said filter is constructed of a polysulfone polymer.

25. The stopper of claim 21 wherein said filter is constructed of a nylon polymer.

26. The stopper of claim 21 wherein said filter is constructed of a cellulose acetate polymer.

27. The stopper of claim 21 wherein said filter is constructed of a hydrophilic material.

28. The stopper of any one of claims 22–27, inclusive, wherein said filter has a star-shaped cross-section.

29. A stopper for a medicine vessel comprising:

an annular plug, said annular plug having an attachment end and a fastening end, said fastening end capable of frictional engagement with an opening in said medicine vessel, said annular plug sealing said medicine vessel;

a band surrounding said annular plug and an upper portion of said medicine vessel; and said annular plug further comprising a luer connector integral with said annular plug and extending from said annular plug, said luer connector defining a channel for fluid passage.

30. The stopper of claim 1 wherein said luer connector comprises a female luer fitting.

31. The stopper of claim 1 wherein said luer connector comprises a male luer fitting.

32. A stopper for a medicine vessel comprising an integral luer fitting, said integral luer fitting having an attachment end and a fastening end, said fastening end capable of engagement with a lip surrounding an opening in said medicine vessel, said integral luer fitting sealing said medicine vessel, said integral luer fitting further comprising a luer connector that extends from said attachment end, said luer connector defining a fluid passage opening.

* * * * *